US008777044B1

(12) United States Patent
Raymus et al.

(10) Patent No.: US 8,777,044 B1
(45) Date of Patent: Jul. 15, 2014

(54) BEVERAGE CONTAINER DEVICE

(71) Applicants: Tommy Raymus, San Diego, CA (US); Robert Sinclair, Manteca, CA (US)

(72) Inventors: Tommy Raymus, San Diego, CA (US); Robert Sinclair, Manteca, CA (US)

( * ) Notice: Subject to any disclaimer, the term of this patent is extended or adjusted under 35 U.S.C. 154(b) by 0 days.

(21) Appl. No.: 13/761,978

(22) Filed: Feb. 7, 2013

Related U.S. Application Data

(60) Provisional application No. 61/685,324, filed on Mar. 16, 2012, provisional application No. 61/614,094, filed on Mar. 22, 2012.

(51) Int. Cl.
*B65D 1/24* (2006.01)

(52) U.S. Cl.
USPC ..... 220/526; 215/6; 215/12.1; 222/94; 222/129; 220/500; 220/524

(58) Field of Classification Search
USPC ..... 220/500, 524, 526; 215/6, 12.1; 222/94, 222/129
See application file for complete search history.

(56) References Cited

U.S. PATENT DOCUMENTS

| | | | | |
|---|---|---|---|---|
| 4,838,464 | A * | 6/1989 | Briggs | 222/478 |
| 6,283,316 | B1 * | 9/2001 | Sherman | 215/6 |
| 7,258,251 | B2 * | 8/2007 | Johnson | 222/129 |
| 2002/0030063 | A1 * | 3/2002 | Leray et al. | 222/129 |
| 2010/0237034 | A1 * | 9/2010 | Kountotsis | 215/6 |

* cited by examiner

*Primary Examiner* — Fenn Mathew
*Assistant Examiner* — Elizabeth Volz
(74) *Attorney, Agent, or Firm* — Donn K. Harms

(57) ABSTRACT

A beverage holding device comprising a container and a removably engageable lid. The container includes a partition extending between opposing sides of the sidewall of the container to define a plurality of separated cavities. The partition includes an edge surface forming an interior seal against a lower surface of the lid upon an engagement of the lid with the container for maintaining the plurality of cavities fluidly separated. A plurality of apertures in offset elevated positions above an upper surface of the lid are provided, with each communicating with a respective one of the plurality of cavities. The elevated and offset apertures provide a respective relief area to accommodate a projecting nose of a user during an engagement of the user's mouth with a respective aperture while tipping the container.

5 Claims, 2 Drawing Sheets

BEVERAGE CONTAINER DEVICE

BACKGROUND OF THE INVENTION

1. Field of the Invention

This application claims priority to U.S. Provisional Application Ser. No. 61/685,324 filed on Mar. 16, 2012, and Provisional Application Ser. No. 61/614,094 filed on Mar. 22, 2012, and are incorporated herein in their entirety by reference thereto.

The present invention relates generally to beverage containers. More particularly, the invention relates to a reusable beverage container device having a plurality of cavities and a removably engageable lid. Individual sealable apertures in the lid provide separate access to the cavities of the container, and are disposed in an opposing staggered configuration on the lid. Mesh or other screen material communicate between the lid and container and act to enhance the mixing capability of the container when filled with a liquid and a powder, gel, or other liquid solute for the purpose of mixing a combination thereof. In at least one preferred mode, the container device is configured to receive individual cartridges of powder, gel, or other liquid solute which can be introduced and mixed with a liquid substrate contained within the device.

2. Prior Art

Beverage containers are widely known and used throughout the world. In many industries beverage containers are provided in single-use containers such as paper or plastic cups. However, in order to reduce waste, many consumers prefer to use reusable containers for their beverage needs. Reusable containers typically come in the form of rigid plastic, glass, or metal containers which can be washed and reused as needed. Such reuse substantially reduces the waste related to single-use cups or containers which are simply discarded after their first use.

Conventional reusable beverage containers typically include a single liquid receiving cavity employable for filling, storage, and as the reservoir for the beverage the user consumes. Often, a removable and sealable lid is provided with reusable containers such that the user can employ the container in an on-the-go manner without the hazard of spilling any of the liquid. However, as noted, conventional containers are limited to containing a single liquid and as such limit the user to a single liquid per use. Therefor, users who desire to enjoy multiple beverages, must employ a separate container for each beverage.

This is especially true for container users who frequent a gym. Often, gym patrons will carry bottles for both water as well as other supplement type beverages such as sports drinks or nutritional supplement drinks. Nutritional supplements which are increasingly popular are frequently supplied in the form of powders, gels, or other dissolvable concentrates, which adapted to be mixed onsite with water or milk in specialty containers referred to as shaker bottles or shaker cups. Usually the gel or powder is held in a separate container and poured into the shaker cup for consumption and mixed accordingly with water or milk. This allows the user to obtain a freshly mixed nutritional beverage, either directly before or after an exercise workout routine, and is desirable in many exercise regimens.

However, if the user desires to consume a plurality of beverages, such as multiple supplemental nutrition beverages, sports drinks, and/or water, the user is burdened with the need to hold or transport multiple containers for both the mix liquids and powdered nutritional supplements which can be quite a nuisance. The user also risks the chance that one of the containers might be lost or stolen and missing their liquid or supplement.

Nutrition is essential to the recovery and rebuilding of the body and it has been professed in much exercise literature that the precise timing of consuming such supplements is the key. Post-workout, should a user delay even an additional 10 minutes to consume the nutritional supplement, such can prove very costly to the recovery process, the hormonal response, and serum/cell nutrient levels. Most people going to the gym do not have a solid meal available for consumption directly after completing their workout. This is why many users consume supplements before and after workouts which are conventionally mixed on the spot in a shaker cup.

Pre-workout supplements consumed by users typically employ ingredients designed to provide users such as gym patrons and athletes, energy for use during their workout, prior to their workout. The marketplace and consumer behavior are exhibiting an increase in the consumption of such pre-workout powders. This growth in the use of nutritional supplements parallels the growth in the consumption of energy products and beverages in previous years.

Just as post-workout nutrition timing is critical, pre-workout timing is said to be just as important. The specific instructions for consumption of many powder supplements differs in the time it should be consumed before a workout. Consuming such supplements too early can result in reduced efficiency at the tail end of a workout. Additionally, early consumption can cause overstimulation such as during the car ride to the gym which can be unnerving should the ride be too long or the user delayed in their arrival. Conversely, consuming a particular nutritional supplement later than advised, may not allow the user's body to fully utilize the benefits during a workout.

One current solution to the multiple supplement need and the need for sequential timing, is for the user to carry two bottles such as shaker cups with each containing pre-workout and post-workout supplements. However, carrying a plurality of different containers is cumbersome and ineffective. Alternatively, some users employ one bottle to mix and consume each drink which may result in a mistiming of nutrition consumption and result in poor performance during exercise and impaired recovery.

Recently intra-workout nutritional powders, which are mixed with a liquid and consumed during an exercise workout, have been making a strong increase in use in the supplement market. Additionally, increasing in popularity is the need for water hydration which has been found to be beneficial when exercising. Such a combination of different beverages however requires multiple containers and mixing in one of those containers.

However, carrying two or more shaker cups to the gym or other exercise venue, is not only inefficient but also inconvenient. Frequently during such exercise regimens the user will typically carry a phone and/or music player and car keys. The addition of two or more shaker cups to the already burdened user, eliminates all their free hands moving around the gym from one exercise machine to the next. Such sequential stationing is performed by most body builders numerous times throughout a workout.

As a result, prior art has attempted to provide a solution through devices configured to contain multiple liquids within a single container. U.S. Pat. No. 7,975,868 to Flies et al. teaches a beverage container having at least two separate and distinct compartments separated by a vertical partition, an inner liner, an outer shell, and a removable lid with sealable openings for each compartment. Each compartment can be filled with the liquid of choice and the user can employ the separate openings for the consumption of each liquid individually.

However, many downfalls of this device are apparent. Firstly, the device to Flies does not provide improvement in the task of mixing powder or gel nutritional supplements with a liquid. Again, many supplemental nutrition users desire to mix dissolvable supplements onsite in order to have a fresh solution of nutritional supplements. The device to Flies still requires the user to separately carry a dissolvable nutritional supplement and pour it into the container when desired. The user risks the chance of either forgetting or losing one or both of the container and supplement, or possibly spilling liquid from the container during removal and replacement of the lid.

Further, one skilled in the art can clearly discern a design flaw of the device to Flies. The lid to Flies shows two in-line openings and closure members providing access to the separate compartments. As such, when consuming from one side or the other by engaging ones lips to the opening and tilting the container upwards, the in-line closure member of the opposite side will interfere by contacting the user's nose and face which is inline with the user's mouth, and therefor require the user to strain their neck backwards to properly tilt the container for consumption of all liquid therein.

The prior art noted above, as well as others, fail to provide a beverage container which provides improvements in both supplemental nutrition mixing as well as separate containment of a plurality of liquids.

As such, there is a continuing unmet need for a beverage container device to solve such multiple beverage and mixing problems. Such a device should be configured with separate and distinct cavities for containment of a plurality of individual liquids. Such a device should provide means for improved mixing of dissolvable nutritional supplements and at least one liquid. Lastly, to provide additional advantage over prior art, such a device should provide means for containing a dissolvable nutritional supplement within a container cavity but maintained separate from a contained liquid, in a manner which will allow for immediate and thorough mixing by the user, only when desired. For example, the device can be configured to receive removable cartridges of pre-measured nutritional supplement which can be placed in the device and mixed at will.

Nutritional timing has been proven by research to be more and more important for bodybuilding, athletes and health conscious individuals. The demand by consumers is to mix and intake adequate nutrition directly before and after a workout. Previous containers do not contain the functionality and design to meet the needs of the current consumer. The invention described in this patent is designed specifically to meet these needs and is an improvement over prior art.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art and achieves the above noted goals through the provision of a beverage container device comprising in a first particularly preferred mode, a container formed by a sidewall terminating at an edge on one side and at an endwall on the opposite side. The internal cavity within the area between the sidewall, endwall, and edge provides an area configured with a plurality of separate and distinct cavities.

Sealing the internal cavity is an engageable and sealable locking lid which can be configured for removal. To provide individual access to each of the plurality of cavities, a plurality of sealable apertures communicate through the lid in registered positions corresponding to those of the plurality of cavities. Additionally provided is a means for enhancing the mixing of the contained liquid in one or both of the plurality of cavities, with one or a combination of liquids, powders, gels or pills.

In accordance with at least one preferred mode wherein the container portion of the device employs two distinct cavities between the sidewall, endwall, and top edge of the sidewall. Sealable apertures positioned on the lid provide a communication with each of the cavities. Preferably, each of the apertures is positioned in an opposing staggered configuration relative to each other. In this mode the apertures are disposed on opposite sides of the lid and communicate with each of the two different cavities. The apertures are preferably offset from an imaginary diameter centerline and positioned in this staggered manner.

An angled or hemispheric lid surface combined with this staggered offset is particularly preferred. With this configuration, a user consuming from either aperture offset from the other, and with the lid of the aperture open and matching the angle of the top of the lid, will not encounter interference or contact of the user's nose or face against the lid or other aperture, while drinking from the container device while tilting the container up towards the user's face.

Further, the sealable apertures when positioned offset on the lid are preferably disposed on raised spouts formed by a spout sidewall raised above the top of the lid. The raised spouts provide an easier engagement with the mouth of the user and add an additional distance from the exterior surface of the lid for the user's nose and face. This configuration thus allows the user to rapidly consume the beverage as is often desired during high energy and rapid workout routines.

In addition, means for maintaining a secured engagement of the lid to the edge of the sidewall of the container is preferably enhanced through the provision of a plurality of hinged clamps engaged to one of the sidewall or the lid which can be locked into an engagement with a plurality of complimentary tabs disposed to the other of the sidewall or the lid. This enhanced secured engagement is especially desirable as the mixing of powdered or dry nutritional supplements with a liquid within the container is often accomplished by shaking the container very vigorously which impacts the lid with the mass of the liquid therein. Prior art devices which employ threaded and other types of engagement means are known to come loose during transport from movement and vibration and can leak or completely detach during such vigorous mixing. As such the preferred engagement means, described in more detail herein, solves such leaking and detachment problems and is especially preferred.

Enhanced mixing capabilities of the device is preferably provided by one or a plurality of liquid permeable surfaces such as meshes, grates, or screens, disposed for communication with a respective one or plurality of the cavities. The permeable surfaces may also be in a sandwiched engagement between the lid and container portion.

The permeable surface such as a screen provides a means for physically separating a concentrated nutritional supplement in the form of gel, powder, or pill from the liquid within the communicating cavity, prior to a deliberate mixing by the user. It is noted that the screen or mesh size can be of the designer's choice as needed for specific mixing requirements, and therefor may vary, however are anticipated in this disclosure. Further, the permeable surface provides a means for breaking up clumps of dissolvable solute into finer suspensions during a mixing therefor enhancing the mixing process for producing a more homogenous solution.

In yet another particularly preferred mode of the device herein providing immense improvements over prior art, the device may be configured as a system for receiving pre-configured cartridges containing pre-measured amounts of nutritional supplement. The supplement cartridges may contain one or a combination of powder, liquid, gel or solid nutritional supplement, which when placed in the device on the permeable surface are maintained separated from any liquid held in the communicating cavity. This configuration will eliminate the need for the user to pre-measure amounts of nutritional supplement and pour it into the container, and instead allows the user to have the supplement ready to mix prior to reaching the gym.

This employment of a container adapted to cartridges additionally eliminates the need to carry the supplement separately. The cartridges may have a liquid soluble lid, mesh covering, coating or other suitable communication for liquid, such that a shaking of the device to cause contained liquid to saturate the cartridge, will dispense the contents for mixing.

Alternatively, the cartridges may employ a pull tab lid or the like such that, when ready, the user removes and opens the cartridge and places it back into the device for mixing. Still further, the permeable surface may include a means to puncture the cartridge, however, will not allow the contents to mix until the device is deliberately shaken by the user.

Using pre-configured cartridges adapted for employment with the permeable surface of the cavities of the container will allow for the cartridges containing supplements to be sold in venues such as the gym or supermarket in a wide variety of contents. Thus, the user may store numerous cartridges and bring them with the container, or buy the cartridges at the venue where the container will be used.

It is noted that the present invention is not limited to only sports beverages with the dual compartment container. There has been a recent and dramatic shift in the food and beverage industry toward organic and sustainable juices. A consumer can now put in their own homemade fresh juices or use store bought juice for a delicious mix of flavors simultaneously instead of the usual enjoyment of only one.

The device applications will be widely used by more than just fitness and health orientated consumers but can reach an audience of working class individuals, students, kids, and more. Students can now experience in one easy portable container device, the stimulating effect of caffeine in one cavity of the container and the hydrating benefits of water it the other. Further, one container of the device can be used for storage of any school supplies or supplements while the other contains a beverage.

The device can be employed by families and children. Children can opt to have drink combination of chocolate milk/juice, soda/slushie, etc. Those skilled in the art will additionally recognize slight modification such that the device can be employed for use with infants to allow mothers the ability to give the infant juice/milk or water/juice or any combination thereof through an operatively engaged nipple or other suitable dispensing means. The device may also function as a cooling container. By placing ice in one cavity of the container a liquid in the adjacent cavity will cool and the ice will maintain the liquid cold without diluting the beverage as the ice melts. The device can also be used as a storage device for powders, foods, keys, ID's, Credit Cards, Wallets, Phones, or other small items while still having the ability to drink liquids from other cavities thereof.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

Objects, features, and advantages of the invention will be brought out in the following part of the specification, wherein detailed description is for the purpose of fully disclosing the invention without placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings.

Figure 3:
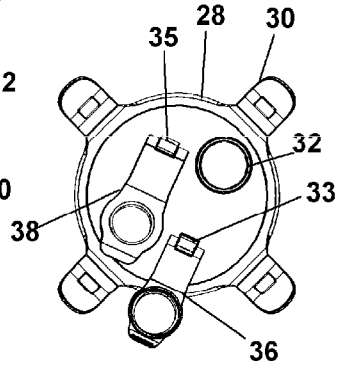
FIG. 3 shows a top view of a preferred mode of the lid portion of the device.
Figure 3A:
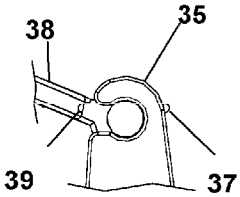

FIG. 3*a* shows a cross sectional view of the hinged engagement of the individual caps to the lid in offset positions.

Figure 4:
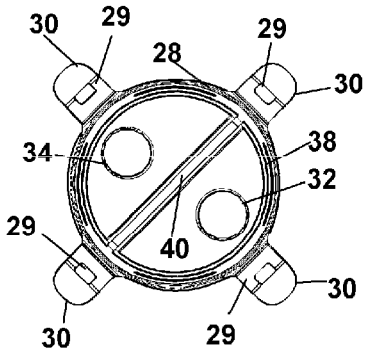

FIG. 4 shows a bottom view of the preferred mode of the lid of FIG. 3.

Figure 1:
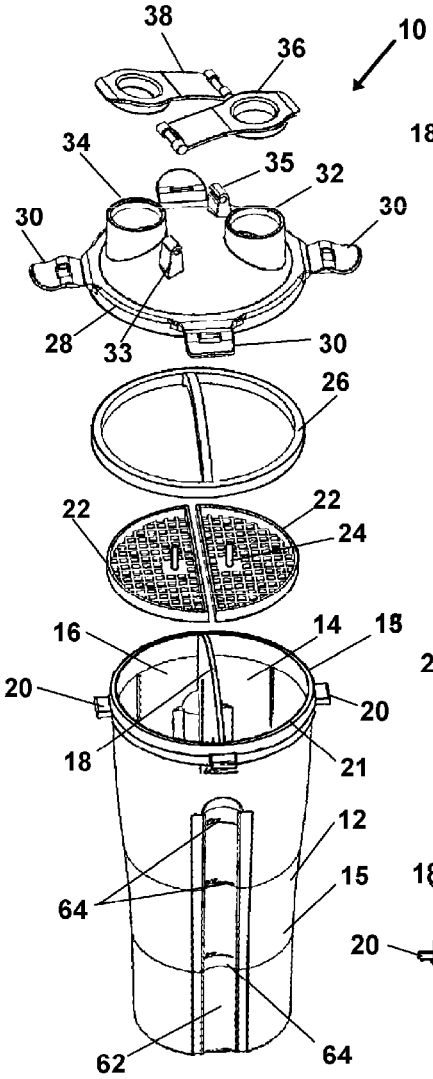
FIG. 1 shows an exploded view of a particularly preferred mode of beverage container device showing the dome shaped lid and underlying container.
Figure 5:
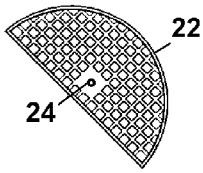

FIG. 5 shows a top view of a preferred mode of the mixing screen of the device of FIG. 1.

Figure 5A:
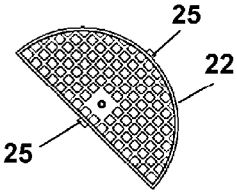

FIG. 5*a* shows a top view of another preferred mode of the mixing screen of the device which is rotatably engaged to provide a means for enhanced mixing.

Figure 6:
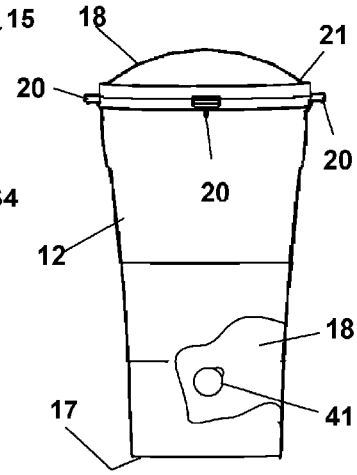

FIG. 6 is a side view of the container component of the device showing the raised partition communicating between the two compartments of the container, also showing a cut-away view depicting a removable plug engaged to the partition for closing an aperture communicating between the two cavities of the container.

Figure 7:
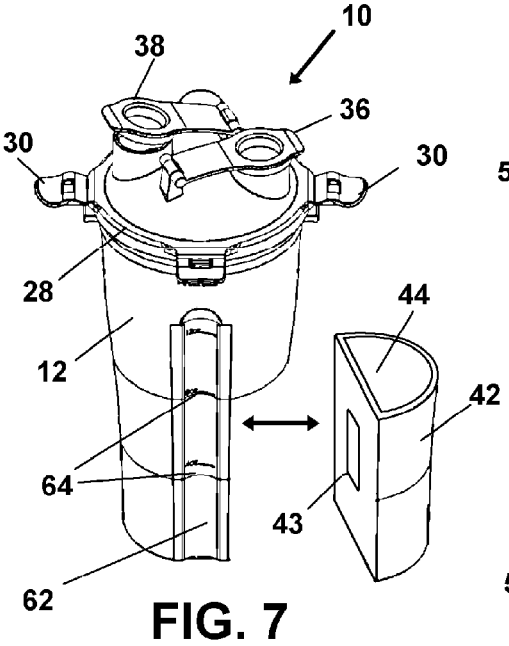

FIG. 7 is a perspective assembled view of the mode of the device of FIG. 1.

Figure 8:
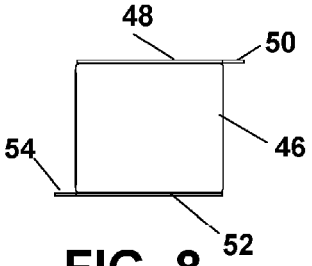

FIG. 8 is a side view of a first particularly preferred mode of a nutritional supplement cartridge system which is especially well suited for employment with the device.

Figure 9:
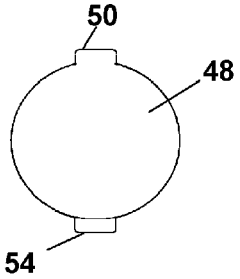

FIG. 9 is a top view of the cartridge of FIG. 8.

Figure 10:
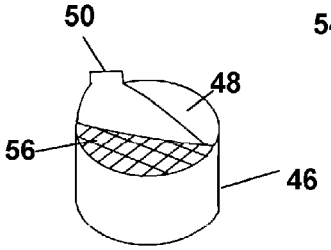

FIG. 10 shows the cartridge of FIG. 8 depicting the peal-away lid exposing a mesh screen employed for dispensing the supplement when mixed with a liquid, such as water or milk.

Figure 11:
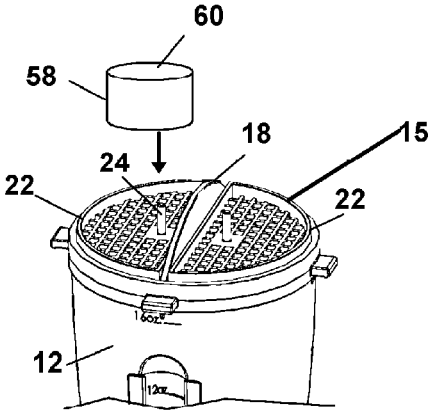

FIG. 11 shows a view of yet another preferred mode of the cartridge system for dispensing a nutritional supplement by piercing a surface of the cartridge with a piercing member on the mixing screen.

Figure 12:
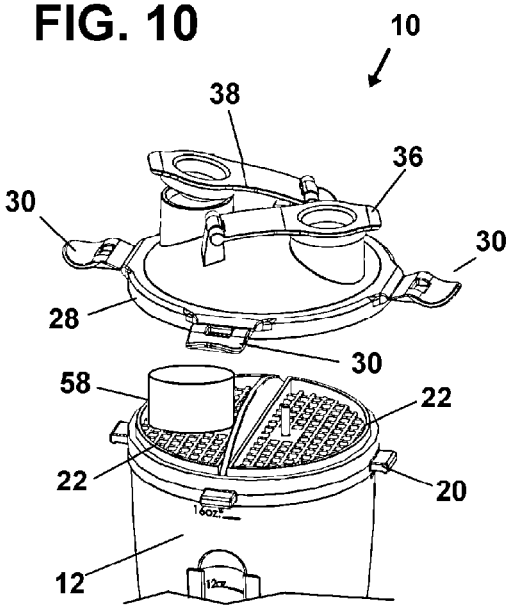

FIG. 12 shows the cartridge of FIG. 11 pierced by the mixing screen, and after engaging the lid, a deliberate shake of the device containing a liquid in the container portion will cause the contents of the cartridge to dispense and mix.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Now referring to drawings in FIGS. 1-12, wherein similar components are identified by like reference numerals, there is seen in FIG. 1 an exploded view of a particularly preferred mode of the beverage container device 10. The device 10 generally consists of a container 12 formed by a sidewall 13 extending between an edge 15 on one end and a bottom wall 17 at the opposite end. Within the container are a plurality of separate and distinct fluidly sealable compartments or cavities with a plurality of two being a current favored mode.

Also employable in combination with the container are one or a plurality of liquid permeable surfaces, such as screens 22 (FIG. 5), and a seal 26 for sandwiched engagement between the container and a preferably hemispheric or dome-shaped lid 28. The various components of the device disclosed herein can be formed of conventional materials such as plastic, metal, or glass however can be formed of any material suitable for the purposes set forth in this disclosure.

In the current preferred mode the plurality of cavities within the sidewall of the container 12 is two, shown in the figure as a first cavity 14 and a second cavity 16. The cavities 14, 16 are separated by a vertical partition 18 which extends past the edge 15 in an arc shape matching the arc or curve of the interior surface of the dome-shaped lid 28, in an arching fashion above the top edge 15 of the container 12 (shown more clearly in FIG. 6). In at least one preferred mode the partition 18 may be removably engaged within the container 12 through a sealed engagement with slots formed on the interior sidewall of the container 12. However in other mode the partition 18 and container 12 are preferably a unitarily structure.

As can be seen, it is preferred that an inwardly curved recessed sidewall portion 62 of the container 12 is provided and preferably aligned with the side edge of the partition 18. The recessed sidewall portion 62 can be formed as an elongated concave recess as shown, which extends the majority of the height of the container 12.

By such positioning of the sidewall portion 62 aligned with the partition 18, gradient indicia markings 64 may be preferably provided which extend along the height of the recess 62. The markings 64 are positioned such that they indicate the fill volume of the cavities at the given height within the container 12 for both cavities 14, 16. In a preferred mode, the container 12 is formed of sufficiently transparent or opaque plastic, such that the recess 62 aligned with the partition 18 provides a means for viewing both cavities 14, 16 of the container 12 at the same time during a filling of fluid or solid within one or both cavities 14, 16. As such the user is provided with a 'measure once' feature which allows the user to fill both cavities 14, 16 to separate desired fill volumes while viewing the single recess 62. Ascertaining the volume contained in either cavity 14 or 16, is also easily discerned by viewing the single recess 62 and the markings 64 therein.

Further, shown in the cut-away portion of FIG. 6, the partition 18 may include a removable plug portion 41 covering an aperture communicated between the two cavities 14, 16 which the user can selectively disengage to provide a means for allowing the liquids in both containers to intermix if desired. This function highly increases the ability of the device 10 to suit the needs of performance athletes and gym enthusiasts. The plug 41 makes the device 10 essentially a single chamber bottle when removed. Liquids can pass through an aperture formed in the partition 18 of which the plug 41 covers. This allows for the user to employ the device 10 like any regular bottle when the plug 41 is pulled, but when the plug 41 is engaged it fully separates two liquids within the respective cavities 14,16.

Figure 2:
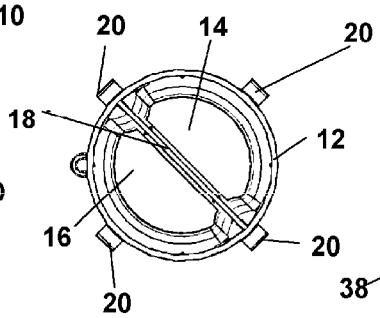
FIG. 2 shows a top view of a preferred mode of the container portion of the device.

The partition 18 may be substantially centrally located such that the cavities 14, 16 are of equal size and volume as shown in the top view of FIG. 2, however it is noted that the partition 18 may be placed in an offset to create unequal sized cavities 14, 16 if desired.

The raised arch partition 18 provides additional utility in providing a means for preventing spillover of powder and liquids when pouring them into a specific cavities 14, 16 with the lid 28 removed. It is often necessary to strictly maintain separation of nutritional supplement as different supplements are needed during different times in a workout routine. During a high energy workout, the user may have to take a break to fill or refill the device 10 with additional supplement and liquids as needed. This most often must been done quickly as the user may do not desire to break the rhythm of their routine or let their heart rate drop due to an extended break. Therefor, the provision of the raised partition 18 allows the user to rapidly pour fluids and solids into the cavities 14, 16 without the occurrence of spillover, and may then quickly return to their workout.

This is opposed to the prior art device having a dividing wall separating two cavities which is flush with the brim of the cup and may cause powders or liquids to be accidentally poured in the wrong chambers during filling. Further, the provision of the raised sidewall 18, with a curved edge matching the curve of the dome shaped lid 28 and forming a seal in a contact with the lid 28, assures that any contents within the cavities 14, 16 will remain separated when the top lid 28 is removed. The arching sidewall additionally provide more surface area contact with the seal 26 between the lid 28 and provides a means for enhanced engagement of the lid 28 to the container 12 further preventing leaks. Experimentation has shown that the present invention solves many of the problems associated with prior art and is a vast improvement.

At or near the top edge 15 of the container 12 are a plurality of locking tabs 20 extending therefrom which are employed in a complimentary engagement with hinged clamps 30 of the lid 28. The engagement of the clamps 30 to the tabs 20 provide a means for sealable and secured engagement of the lid 28 to the container 12. Along with the employment of the seal 26 which extends around the upper edge 15 of the container and over the raised sidewall 18, the operative engagement of the locking clamps 30 create an enhanced compressive seal for maintaining a secured engagement of the lid 28 to the container 12 compared to many prior art device. Prior art devices which employ threaded and other type engagement means are known to come loose, leak, or completely detach during such vigorous mixing. As such the preferred engagement means and excellent compressed seal of lid 28 and container provided by the clamps 30 and tabs 20 solves theses problems and is especially preferred.

However, it is noted that other means for providing a locked and sealed engagement of the lid 28 to the container 12 may be provided and are anticipated. This may include or one a combination of snap fits, improved threaded engagement, and other suitable means.

A plurality of mixing screens 22 may be additionally provided. The mesh or other type screens 22 are engaged to and communicate between the lid 28 and container 12 and act to enhance the mixing capability of the container device 10 when filled with a liquid substrate and a powder, gel, or liquid solute for the purpose of mixing a combination thereof. During a vigorous shaking of the device 10 by the user, the screens 22 sift the solute and provide a means for breaking up clumps of solid solute if present, such as nutritional supplement powder, to achieve a homogenous mixture. In addition to enhancing mixing, the screen 22 provide a means for physically separating a concentrated nutritional supplement in the form of gel, powder, or pill from a liquid contained there below in the container 12 prior to a deliberate mixing by the user.

For example, the user can fill the container 12 with their favorite liquid, such as water or milk, place a powder, gel or other form nutritional supplement on top of the screens 22, and lock the lid 28. When it is desired to mix the two, the user will simply shake the device 10 to communicate the liquid trough the screens 22 to dissolve the supplements. It is noted that the mesh size of the screen 22 (FIG. 5) can be of the designers choice as needed for specific mixing requirements, and therefor may vary, and is anticipated in this disclosure. Further, shown in FIG. 5*a*, the screens 22 may employ axil components 25 which provide a means rotatable engagement with the container 12 for further enhanced mixing means.

Further, it is noted that the device 10 is capable of acting as it own cooling means, similar to the application of an ice wand in prior art devices. Many prior art devices employ insulated container devices that do not allow for adequate heat transfer between adjacent cavities. In this invention, the partition 18 can be formed substantially thin to allow for the cooling of one cavity when ice or other cool liquid is placed in the other.

FIG. 3 and FIG. 4 show top and bottom views respectively of the lid component 28 of the device 10. The lid 28 is configured for a sealed secured engagement with the container 12. The employment of the seal component 26 will ensure a sealed engagement of the lid 28 with the container as well as maintain fluid impermeable seal between the cavities 14, 16. In the bottom view of FIG. 4, the lid 28 includes an annular cavity 38 and substantially central cavity 40 which align and register for a sealed engagement with the seal 26 engaged over the top edge 15 and raised partition 18 of the container 12, respectively.

Referring back to FIG. 3, the lid 28 includes a plurality of apertures 32, 34, which, when engaged to the container 12 communicate and align with the plurality of cavities 14, 16. Further, as can be clearly seen in FIG. 1, the apertures 32, 34 are disposed on raised spouts extending from the lid 28 thereby providing a means to raise the apertures 32, 34 from the top surface of the dome shaped lid 28.

The raised apertures 32, 34 as well as the stagger disposition of the apertures 32, 34 relative to an imaginary centerline, along with the relief provided by the slope of the dome shape of the lid surface, opposite each aperture 32, and 24, provide a means for preventing the raised apertures 32 or 34, or the lid surface, from hitting the users nose or face upon drinking from the other aperture 32 or 34, thereby allowing the user to rapidly consume the beverage as is often desired during high energy and rapid workout routines. As such the staggering of the apertures 32 and 34 and the dome shape of the lid 28 providing facial space from the formed relief, are most preferred.

In addition, the apertures 32, 34 are preferably relatively wide openings to allows for easy insertion of ice cubes in either cavities 14, 16. This will eliminate the conventional need to employ ice wands or similar devices which must be placed in a freezer for long periods of time before they can serve their function.

Again, in the preferred mode the number of cavities 14, 16 is two, and therefor the lid 28 employs two apertures 32, 34. The apertures 32, 34 can be operatively sealed by corresponding cap member 36, 38. The caps 36, 38 are preferably rotatable engaged to the lid 28 via respective hinge portions 33, 35 which lie inline with apertures 32, 34.

Further, FIG. 3*a* depicts a cross sectional view of the rotatable engagement of the cap 38 to the hinge portion 35. It is preferred that the hinges 33, 35 and caps 36, 38 employ respective tongue 37 and groove 39 portions. Therefor, by rotating the caps 36, 38 to an open position (shown by cap 36 in FIG. 3) such that the tongue 37 and groove 39 engaged, forms a releasable stay which provides a means for preventing the caps 36, 38 from pivoting toward the aperture and hitting the user in the face.

FIG. 7 shows an assembled view of a preferred mode of the device 10. As can be clearly seen, the apertures 32, 34 and respective caps 36, 38 are disposed offset from an imaginary diameter centerline. In this fashion, the user can choose to consume a beverage from one cavity 14, 16 at a time, without the cap of the other cavity interfering with the drinking process, which conventionally involves the tilting of the device 10 up towards the users face.

The clamps 30 are currently shown in the disengaged position, however one skilled in the art can easily discern that by rotating the clamps 30 downward, the apertures 29 formed in the clamps 30 will engage the respective tabs 20 in a secured frictional engagement thereof. Enhanced biased engagement can be provided by forming the distal ends of the tabs 20 slightly or moderately thicker than the width of the apertures 29 of the clamps 30, such that the clamps 30 must be snapped into their engagement with the tabs 20. Further, selective materials can be chosen for the tabs 20 and clamps 30 such that an audible snap is heard by the user when the tabs 20 are successfully communicated through the apertures 29 thereby providing assurance to the user that a secured engagement is accomplished.

In addition, the current mode of the device 10 may include one or a plurality of removably engageable auxiliary container portions 42. The auxiliary container 42 may engage the main body of the container 12 by any suitable removable fastener known in the art, such as hook and loop fabric 43, snap fits, tongue and groove type fasteners, or the like. A cavity 44 is provided in the auxiliary container 42 and is preferably separate and distance from the cavities 14, 16 of the main container 12, such that if desired, the user can employ the auxiliary container for sealed storage of valuables such as keys or money, while the other cavities 14, 16 can be employed for beverages.

It is noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner.

In yet another particularly preferred mode of the invention, a removable cartridge system is provided. The system described below, provides the user with a means for introducing a powder, gel, liquid, or pill form solute with a liquid contained within the device 10 without the need to pre-measure, or separately transport additional materials. In a particular preferred mode the solute is a nutritional supplement like those employed by gym patrons, body builders, and other health conscious individuals.

FIG. 8-FIG. 10 shows a preferred mode of a cartridge device 46 for containing various powder, liquid, or gel form nutritional supplement. The cartridge 46 herein also referred to as a 'nutritional cup', or 'n-cup' for short, can be formed of plastic and include one or a plurality of removable lids 48, 52 made of foil or the like. The lids 48, 52 may include respective tab portions 50, 54 to allow the user to easily disengage the lids as needed. The n-cups 46 will contain pre measured nutritional supplement which the user can purchase in packs or kits having desired nutritional values. A liquid permeable mesh screen 56 may be engaged between the interior of the n-cup 46 and lid 48 such that removal of the lid 48 will still maintain the supplement within the n-cup 46 however will allow liquid such as water or milk to enter the n-cup 46 and dissolve and mix the powder or gel therein.

In use the n-cups 46 are placed in the container device 10 between the screen 22 of one or both cavities 14, 16 and the lid 28. Liquid contained within one or both cavities 14, 16 will remain separate from the n-cup 46 until a deliberate shaking of the device 10 passes the liquid through the liquid permeable surface or support, such as the screen 22 and mixes with the supplement within the n-cup 46. After consuming the beverage, the user can remove the lid 28 then remove and discard the n-cup 46.

Another preferred mode of the nutritional system shown in FIG. 11 and FIG. 12 is provided through the employment of n-cups 58 having at least one pierceable surface 60. Piercing members 24 disposed on the screens 22 are provided to pierce at least one surface of the n-cup 58 to allow the contents to be dispensed. Again the contents of the n-cup 58 can remain separate from any fluid contained within the respective cavity 14, 16 until the user shakes the device 10.

This invention has other applications, potentially, and one skilled in the art could discover these. The explication of the features of this invention does not limit the claims of this application; other applications developed by those skilled in the art will be included in this invention.

Thus, upon reading this disclosure, those skilled in the art may recognize various other means for a compartmentalized container, with offset apertures, enhanced mixing capabilities, and a cartridge system which are considerably or slightly different those disclosed, are considered within the scope and intent of the invention herein, and are anticipated withing the scope of this patent.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed:

1. A beverage holding device comprising;

a container having a sidewall extending from an engagement to a bottom wall to an edge positioned opposite said bottom wall;

a partition extending between opposing sides of said sidewall, said partition defining a plurality of separated cavities positioned within said sidewall and bottom wall;

a lid, said lid having an upper surface opposite a lower surface, said lower surface removably engageable about a circumference of said lid, with a circumferential edge of said sidewall, in a sealed engagement;

said partition having an edge surface, said edge surface forming an interior seal against said lower surface of said lid upon an engagement of said lid with said circumferential edge of said sidewall;

said interior seal and said sealed engagement of said lid to said sidewall maintaining said plurality of cavities fluidly separated;

a plurality of apertures, said apertures in offset elevated positions above said upper surface of said lid, each communicating through a passage running through a sidewall forming said apertures in said elevated positions;

a respective one of each said apertures communicating with a respective one of said plurality of cavities, with said lid in said sealed engagement;

each said elevated and offset apertures having a respective relief area positioned adjacent to a respective sidewall of said aperture and said upper surface of said lid, in a respective position to accommodate a projecting nose of a user during an engagement of said user's mouth with a respective said aperture while tipping said container;

said relief area providing means for an increased angle of said tipping of said container during drinking therefrom, without a contact of said nose of said user with said lid;

said plurality of cavities being two;

said lid configured in a dome shape having a raised central area declining along a curve to said perimeter;

an extending portion of said partition in between said edge of said sidewall, extending in a direction away from said endwall in a curved configuration to match a curve of said dome shape of said lid;

said extending portion of said partition, with said lid removed from said container, providing a shield preventing a liquid being deposited into one said cavity, from communicating into the other of said plurality of two said cavities;

a mixing aperture communicating through said partition between said plurality of cavities;

a removable plug engageable within said mixing aperture; and contents of said plurality of cavities being mixable upon a removal of said plug from said mixing aperture.

2. The beverage holding device of claim 1, additionally comprising:

at least two releasable locking tabs communicating between said lid and said sidewall in opposing positions on said sidewall;

said locking tabs engageable in a connection between said sidewall and said lid and user disengageable therefrom; and whereby said lid is held engaged to said container during a shaking of liquid contents therein and prevented from dismount.

3. A beverage holding device comprising;

a container having a sidewall extending from an engagement to a bottom wall to an edge positioned opposite said bottom wall;

a partition extending between opposing sides of said sidewall, said partition defining a plurality of separated cavities positioned within said sidewall and bottom wall;

a lid, said lid having an upper surface opposite a lower surface, said lower surface removably engageable about a circumference of said lid, with a circumferential edge of said sidewall, in a sealed engagement;

said partition having an edge surface, said edge surface forming an interior seal against said lower surface of said lid upon an engagement of said lid with said circumferential edge of said sidewall;

said interior seal and said sealed engagement of said lid to said sidewall maintaining said plurality of cavities fluidly separated;

a plurality of apertures, said apertures in offset elevated positions above said upper surface of said lid, each communicating through a passage running through a sidewall forming said apertures in said elevated positions;

a respective one of each said apertures communicating with a respective one of said plurality of cavities, with said lid in said sealed engagement;

each said elevated and offset apertures having a respective relief area positioned adjacent to a respective sidewall of said aperture and said upper surface of said lid, in a respective position to accommodate a projecting nose of a user during an engagement of said user's mouth with a respective said aperture while tipping said container;

said relief area providing means for an increased angle of said tipping of said container during drinking therefrom, without a contact of said nose of said user with said lid;

said plurality of cavities being two;

said lid configured in a dome shape having a raised central area declining along a curve to said perimeter;

an extending portion of said partition in between said edge of said sidewall, extending in a direction away from said endwall in a curved configuration to match a curve of said dome shape of said lid;

said extending portion of said partition, with said lid removed from said container, providing a shield preventing a liquid being deposited into one said cavity, from communicating into the other of said plurality of two said cavities;

a mixing aperture communicating through said partition between said plurality of cavities;

a removable plug engageable within said mixing aperture; and contents of said plurality of cavities being mixable upon a removal of said plug from said mixing aperture;

each of said plurality of apertures, situated on the lid in said offset positions in-between said raised central area and said perimeter of said lid;

said relief area increased in depth by said upper lid declining along said curve in said relief area.

4. A beverage holding device comprising;

a container having a sidewall extending from an engagement to a bottom wall to an edge positioned opposite said bottom wall;

a partition extending between opposing sides of said sidewall, said partition defining a plurality of separated cavities positioned within said sidewall and bottom wall;

a lid, said lid having an upper surface opposite a lower surface, said lower surface removably engageable about a circumference of said lid, with a circumferential edge of said sidewall, in a sealed engagement;

said partition having an edge surface, said edge surface forming an interior seal against said lower surface of said lid upon an engagement of said lid with said circumferential edge of said sidewall;

said interior seal and said sealed engagement of said lid to said sidewall maintaining said plurality of cavities fluidly separated;

a plurality of apertures, said apertures in offset elevated positions above said upper surface of said lid, each communicating through a passage running through a sidewall forming said apertures in said elevated positions;

a respective one of each said apertures communicating with a respective one of said plurality of cavities, with said lid in said sealed engagement;

each said elevated and offset apertures having a respective relief area positioned adjacent to a respective sidewall of said aperture and said upper surface of said lid, in a respective position to accommodate a projecting nose of a user during an engagement of said user's mouth with a respective said aperture while tipping said container;

said relief area providing means for an increased angle of said tipping of said container during drinking therefrom, without a contact of said nose of said user with said lid;

said plurality of cavities being two;

an elongated recess formed in said sidewall of said container, said recess aligned along one edge of said partition along said sidewall;

said elongated recess providing an area of said sidewall for viewing of contents of either or both said cavities simultaneously, whereby a user may ascertain the respective contents of one or both cavities by viewing them through said sidewall in said recess, a mixing aperture communicating through said partition between said plurality of cavities;

a removable plug engageable within said mixing aperture; and contents of said plurality of cavities being mixable upon a removal of said plug from said mixing aperture.

5. A beverage holding device comprising;

a container having a sidewall extending from an engagement to a bottom wall to an edge positioned opposite said bottom wall;

a partition extending between opposing sides of said sidewall, said partition defining a plurality of separated cavities positioned within said sidewall and bottom wall;

a lid, said lid having an upper surface opposite a lower surface, said lower surface removably engageable about a circumference of said lid, with a circumferential edge of said sidewall, in a sealed engagement;

said partition having an edge surface, said edge surface forming an interior seal against said lower surface of said lid upon an engagement of said lid with said circumferential edge of said sidewall;

said interior seal and said sealed engagement of said lid to said sidewall maintaining said plurality of cavities fluidly separated;

a plurality of apertures, said apertures in offset elevated positions above said upper surface of said lid, each communicating through a passage running through a sidewall forming said apertures in said elevated positions;

a respective one of each said apertures communicating with a respective one of said plurality of cavities, with said lid in said sealed engagement;

each said elevated and offset apertures having a respective relief area positioned adjacent to a respective sidewall of said aperture and said upper surface of said lid, in a respective position to accommodate a projecting nose of a user during an engagement of said user's mouth with a respective said aperture while tipping said container;

said relief area providing means for an increased angle of said tipping of said container during drinking therefrom, without a contact of said nose of said user with said lid;

said plurality of cavities being two;

said lid configured in a dome shape having a raised central area declining along a curve to said perimeter;

an extending portion of said partition in between said edge of said sidewall, extending in a direction away from said endwall in a curved configuration to match a curve of said dome shape of said lid;

said extending portion of said partition, with said lid removed from said container, providing a shield preventing a liquid being deposited into one said cavity, from communicating into the other of said plurality of two said cavities;

an elongated recess formed in said sidewall of said container, said elongated recess along one edge of said partition along said sidewall;

said elongated recess providing of said sidewall for viewing of contents of either or both said cavities simultaneously, whereby a user may ascertain the respective contents of one or both cavities by viewing them through said sidewall in said recess;

a mixing aperture communicating through said partition between said plurality of cavities;

a removable plug engageable within said mixing aperture; and contents of said plurality of cavities being mixable upon a removal of said plug from said mixing aperture.

* * * * *